US005816512A

United States Patent [19]

Nakashima et al.

[11] Patent Number: 5,816,512

[45] Date of Patent: Oct. 6, 1998

[54] BOBBIN THREAD WINDING MECHANISM

[75] Inventors: Akifumi Nakashima, Ichinomiya; Masao Ogawa, Nagoya, both of Japan

[73] Assignee: Brother Kogyo Kabushiki Kaisha, Nagoya, Japan

[21] Appl. No.: 864,619

[22] Filed: May 28, 1997

[30] Foreign Application Priority Data

May 31, 1996 [JP] Japan ..... 8-138172

[51] Int. Cl.[6] ..... B65H 75/32; B65H 75/28; D05B 59/00

[52] U.S. Cl. ..... 242/21; 112/279; 112/298; 242/20; 242/125.1

[58] Field of Search ..... 242/20, 21, 22, 242/19, 39, 125.1; 112/279, 285, 296, 298, 302

[56] References Cited

U.S. PATENT DOCUMENTS

| | | | |
|---|---|---|---|
| 2,733,868 | 2/1956 | Hamlett | 242/22 |
| 3,162,388 | 12/1964 | Balash | 242/19 |
| 3,741,492 | 6/1973 | Johansson | 242/22 X |
| 3,994,058 | 11/1976 | Sasaki et al. | 242/125.1 X |
| 4,033,273 | 7/1977 | Kasuga | 112/279 X |
| 4,096,812 | 6/1978 | Gegauf | 242/22 X |
| 4,161,153 | 7/1979 | Nawa et al. | 112/279 |
| 4,183,473 | 1/1980 | Neuweiler et al. | 242/20 |
| 5,460,333 | 10/1995 | Vanhuyse | 242/125.1 X |

FOREIGN PATENT DOCUMENTS

| | | | |
|---|---|---|---|
| 59-193374 U | 12/1984 | Japan . | |
| Y2-2-6931 | 2/1990 | Japan . | |
| 4-105691 | 4/1992 | Japan | 112/279 |

*Primary Examiner*—Michael Mansen
*Attorney, Agent, or Firm*—Oliff & Berridge, PLC

[57] ABSTRACT

A bobbin thread winding mechanism includes: a rotating member capable of rotating and to which a bobbin can be mounted; a supporter provided to the rotating member and that supports an end of a bobbin thread to be wound around the bobbin; and a positioner that positions the rotating member so that the supporter stops at a predetermined position.

29 Claims, 10 Drawing Sheets

BOBBIN THREAD WINDING MECHANISM

BACKGROUND OF THE INVENTION

1. Field of the Invention

The present invention relates to a bobbin thread winding mechanism.

2. Description of the Related Art

In conventional sewing machines, there have been known a variety of methods for interrupting transmission of drive force from a sewing machine motor to a needle bar and using the drive force to wind a bobbin thread onto a bobbin. There are also known a variety of methods for first supporting the end of the bobbin thread at the start of bobbin winding operations so that the bobbin thread will be properly wound on the bobbin. One well-known method for supporting the bobbin thread end at start of bobbin wind operations will be described below.

A bobbin is typically spool shaped and includes a cylindrical bobbin thread winding portion and disk-shaped flange portions formed at both ends of the bobbin thread winding portion. A hole is opened through one of the flange portions. A user draws thread from a thread spool and passes the end of the thread through the hole in the flange portion from the thread winding portion side. The user then inserts the bobbin onto a thread winding shaft and starts rotation of the thread winding shaft while holding the end of the bobbin thread in position. Once the thread has been wound onto the bobbin a few times, the user stops rotation of the thread winding shaft and uses scissors to cut the end of the bobbin thread he or she has been holding. Then, the user again starts rotation of the thread winding shaft to wind the thread onto the bobbin.

Japanese Laid-Open Utility Model Publication No. HEI-2-6931 discloses a bobbin for simplifying this troublesome operation. The bobbin is shaped similar to ordinary bobbins and includes a cylindrical portion around which a bobbin thread is to be wound and two flange portions on either side of the cylindrical portion. Also, the cylindrical portion is formed with a hollow center so that the bobbin can be mounted on a bobbin thread wind-up shaft. In the bobbin of Japanese Laid-Open Utility Model Publication No. HEI-2-6931, a hole is formed through the cylindrical portion so as to connect the hollow center and the outer periphery around which the bobbin thread is to be wrapped. The user first threads the bobbin thread through the hole from the outer periphery side to the hollow center. Then the user mounts the bobbin onto the thread wind-up shaft. At this point, the end of the bobbin thread will be sandwiched between the cylindrical portion and the thread wind-up shaft and so will not pull out of the hole. Therefore, the user need not hold the thread end while the bobbin thread in first being wound around the cylindrical portion. With the configuration described in Japanese Laid-Open Utility Model Publication No. HEI-2-6931, the processes of temporarily stopping the thread winding shaft and cutting the end of the bobbin thread after the thread has been wound around the bobbin a few times can be dispensed with.

Japanese Laid-Open Utility Model Publication No. SHO-59-193374 describes a method of holding and cutting the bobbin thread at the start of winding of the thread. Japanese Laid-Open Utility Model Publication No. SHO-59-193374 discloses a thread grasping reel formed from a disk and a pawl wheel. The pawl wheel is formed with notches and pawls. Each pawl forms a thread cutting blade that bends and protrudes away from the disk of the thread grasping reel.

SUMMARY OF THE INVENTION

However, the configuration described in Japanese Laid-Open Utility Model Publication No. HEI-2-6931 can not be used with bobbins generally sold on the market. Also, there is a need to thread the thread through a hole.

In the device disclosed in Japanese Laid-Open Utility Model Application No. SHO-59-193374, neither the thread cutting portion nor the thread holding portion stops at a predetermined fixed position. Also, the relative position between the cutter blade and the thread and also the relative position between the thread and the thread end support plate near the cutter blade will be indefinite. As a result, the thread can not be cut or will not be accurately reliably held and so will pull out. Therefore, a large number of cutting pawls must be provided because there is no way to know where the thread winding shaft will stop when the end of the bobbin thread is to be held and cut.

In order to solve the above-described problems, a bobbin thread winding mechanism according to the present invention includes: a rotating member capable of rotating and to which a bobbin can be mounted; a supporter provided to the rotating member and that supports an end of a bobbin thread to be wound around the bobbin; and a positioner that positions the rotating member so that the supporter stops at a predetermined position.

With this configuration, the bobbin rotates in association with the rotating member. The supporter supports the end portion of the bobbin thread to be wound around the bobbin. When the rotating member stops rotating, the positioner automatically positions the rotating member in order to position the supporter in a predetermined position.

According to another aspect of the present invention, a bobbin thread cutter is provided instead of the supporter. In this case, when the rotating member stops rotating, the positioner automatically positions the rotating member in order to position of the bobbin thread cutter in a predetermined position.

BRIEF DESCRIPTION OF THE DRAWINGS

The above and other objects, features and advantages of the invention will become more apparent from reading the following description of the preferred embodiment taken in connection with the accompanying drawings in which:

FIG. 9(*b*) is a top view showing another modification of the positioning cam portion;

DETAILED DESCRIPTION OF THE PREFERRED EMBODIMENTS

Figure 1:
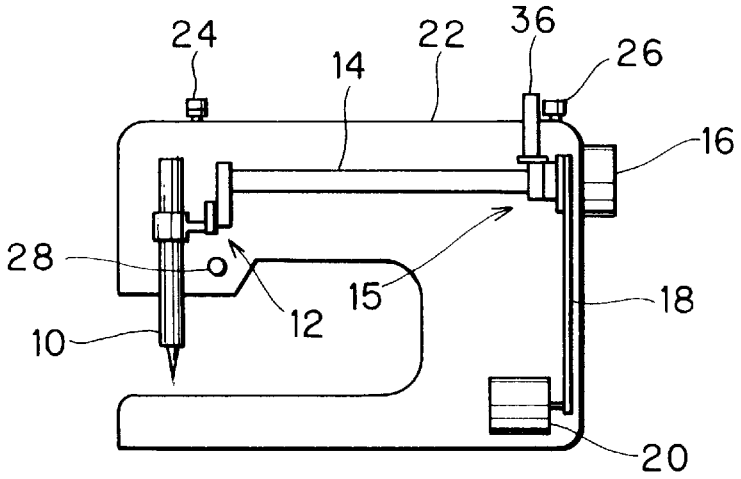
FIG. 1 is a side view schematically showing a sewing machine including a bobbin thread winding mechanism according to a first embodiment of the present invention.

A bobbin thread winding mechanism according to a preferred embodiment of the present invention will be described while referring to the accompanying drawings wherein like parts and components are designated by the same reference numerals to avoid duplicating description.

Figure 2:
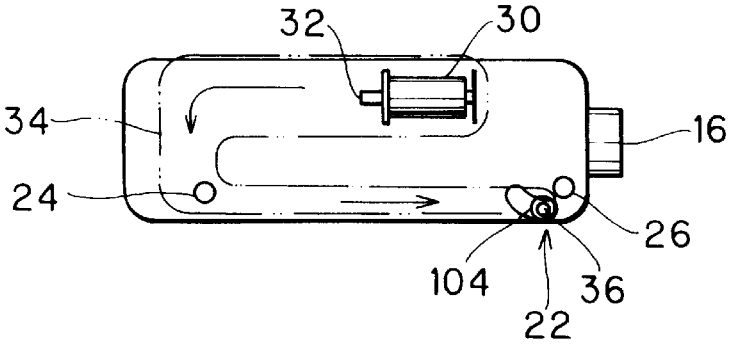
FIG. 2 is a top view of the sewing machine of FIG. 1.

As shown in FIGS. 1 and 2, a domestic sewing machine according to the present embodiment includes: a needle bar 10 to which is attached a needle; and a sewing machine motor 20 for driving the vertical movement of the needle bar 10 via a drive transmission mechanism. The needle bar 10 is disposed at the left end of the sewing machine as viewed in FIG. 1, and the sewing machine motor 20 is disposed at the right lower end of the sewing machine as viewed in FIG. 1. The drive transmission mechanism includes: a clutch mechanism 12 attached to the needle bar 10; a pulley 16 connected to the sewing machine motor 20 by a timing belt 18, which spans between the pulley 16 and the sewing machine motor 20; and a principle shaft 14 attached at its left tip with the clutch mechanism 12 and at its right tip with the pulley 16 by way of a pin joint clutch 15.

The timing belt 18 transmits the drive force from the sewing machine motor 20 to the pulley 16. Via the clutch mechanism 15, the principle shaft 14 rotates in association with rotation of the pulley 16 and transmits rotational force to the clutch mechanism 12, which converts the rotational force into vertical movement of the needle bar 10. A start/stop switch 28 is provided for starting drive of the sewing machine motor 20 when pressed once and stopping drive of the sewing machine motor 20 when pressed again. This operation for turning the sewing machine motor 20 on and off is set by an electrical circuit (not shown in the drawings).

Figure 3:
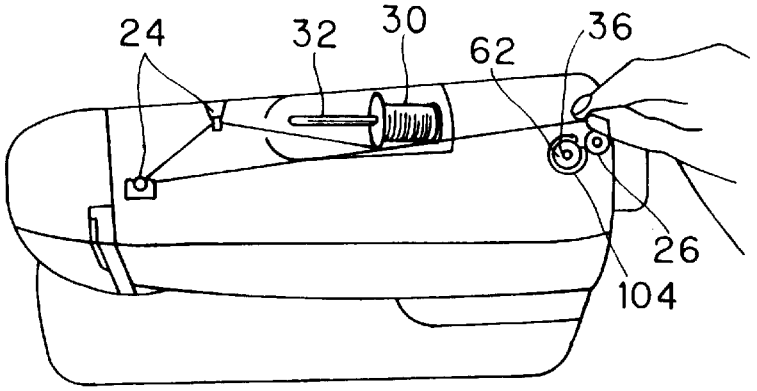
FIG. 3 is a more detailed top view of the sewing machine of FIG. 1.

As shown in FIGS. 2 and 3, a thread wind-up shaft 36 and a thread end support plate 104 of a bobbin thread winding mechanism 22 protrude from an upper cover 60 at the upper right end of the sewing machine. A bobbin winder stop latch 26 is disposed adjacent to the protruding tip of the thread wind-up shaft 36. A spool shaft 32, on which a spool 30 is freely rotatably disposed, is provided at the upper portion of the sewing machine. When thread is to be wound on a bobbin, thread is drawn from the spool 30 and guided along a thread pathway 34 to the bobbin thread winding mechanism 22. One or more thread guides 24 are disposed at turns along the thread pathway 34.

Figure 4:
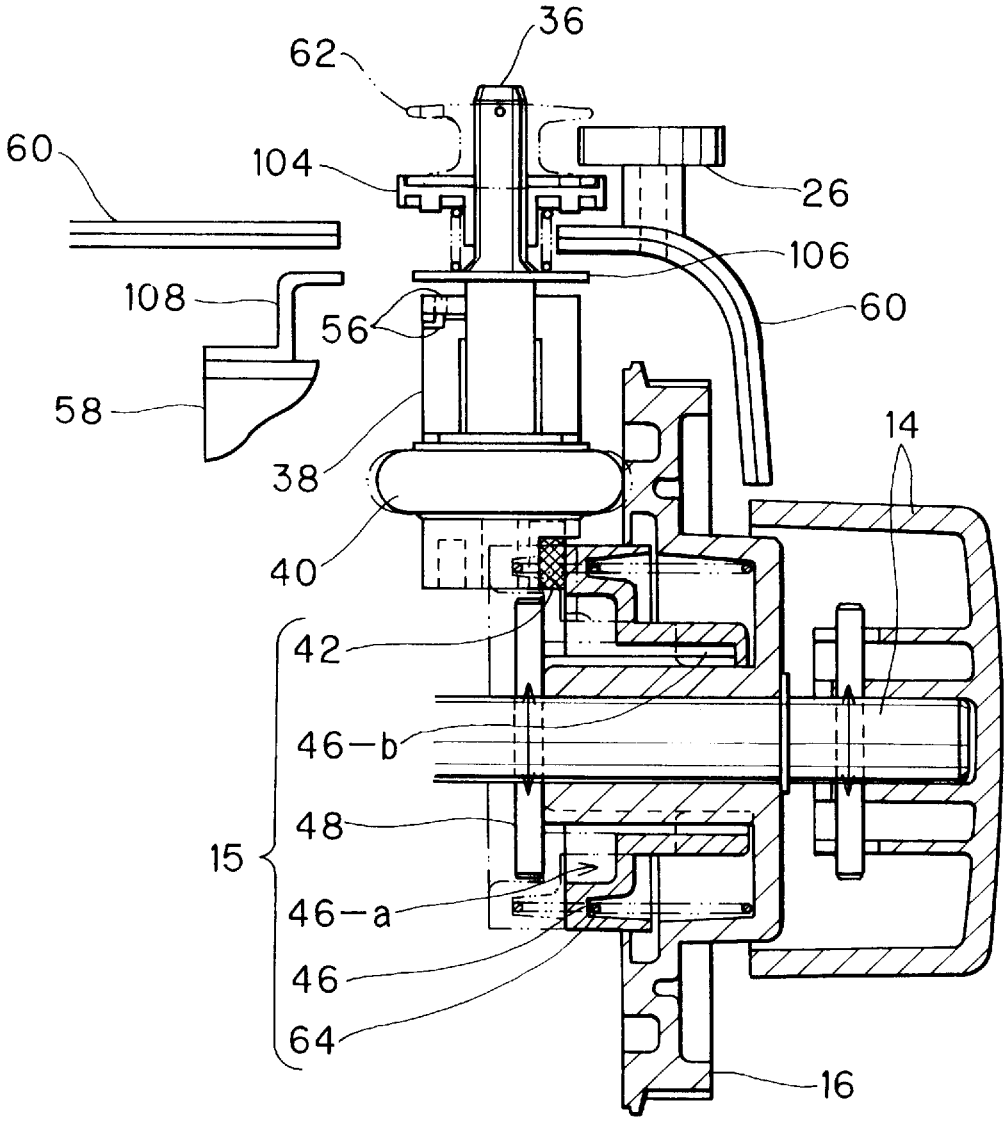
FIG. 4 is a cross-sectional view showing the bobbin thread winding mechanism according to the first embodiment.
Figure 5:
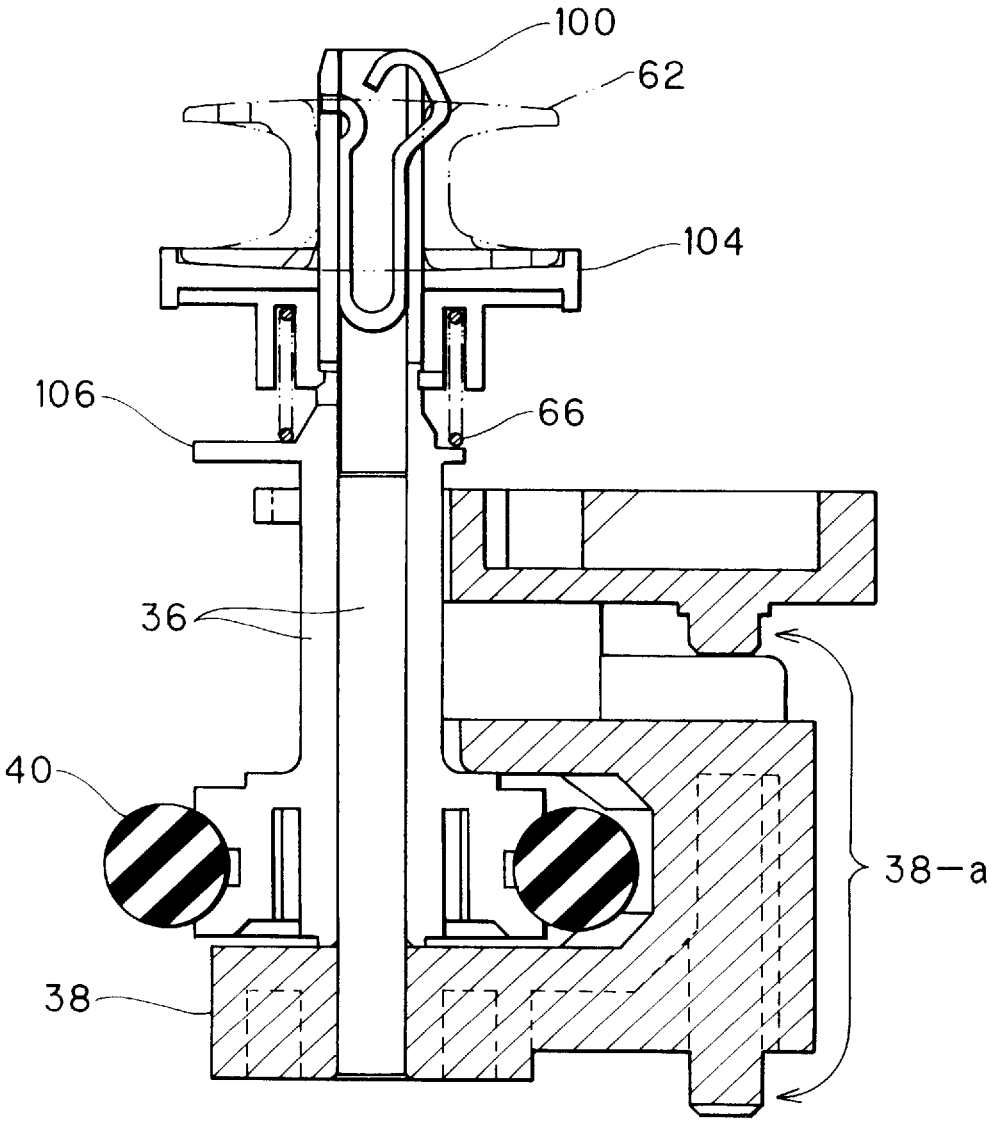
FIG. 5 is a cross-sectional view showing the bobbin thread winding mechanism of FIG. 4 from a different angle.

The bobbin thread winding mechanism 22 will be explained in more detail while referring to FIGS. 4 through 9. As shown in FIGS. 4 and 5, a variety of components are disposed about the thread wind-up shaft 36. From the top to the bottom of the thread wind-up shaft 36, as viewed in FIG. 4, is provided to the bobbin 62, a thread end support plate 104, a positioning cam portion 106, an arm 38, and a rubber ring 40. The thread end support plate 104 and the positioning cam portion 106 are provided so as to rotate integrally with the thread wind-up shaft 36. The rubber ring 40 is fixed to the lower portion of the thread wind-up shaft 36 so as to rotate integrally with the thread wind-up shaft 36.

The bobbin 62 is inserted onto the portion of the thread wind-up shaft 36 that protrudes from the upper cover 60 and is a normal, commercially available bobbin. A thread wind-up shaft spring 100 is fixed to the upper portion of the thread wind-up shaft 36. The thread wind-up shaft spring 100 supports the bobbin 62 so it does not separate from the thread wind-up shaft 36 and so that the bobbin 62 and the thread wind-up shaft 36 rotate integrally with each other.

The thread end support plate 104 is supported between the positioning cam portion 106 and the tip end of the thread wind-up shaft 36 where the bobbin 62 is inserted and is rotatable and movable in the axial direction of the thread wind-up shaft 36. A compression coil spring 66 is provided for urging the thread end support plate 104 toward the bobbin 62. The thread end support plate 104 is formed in a disk shape with its center centered on an axial center of the thread wind-up shaft 36. The thread end support plate 104 has an external diameter somewhat larger than the flange portion of the bobbin 62.

Figure 6:
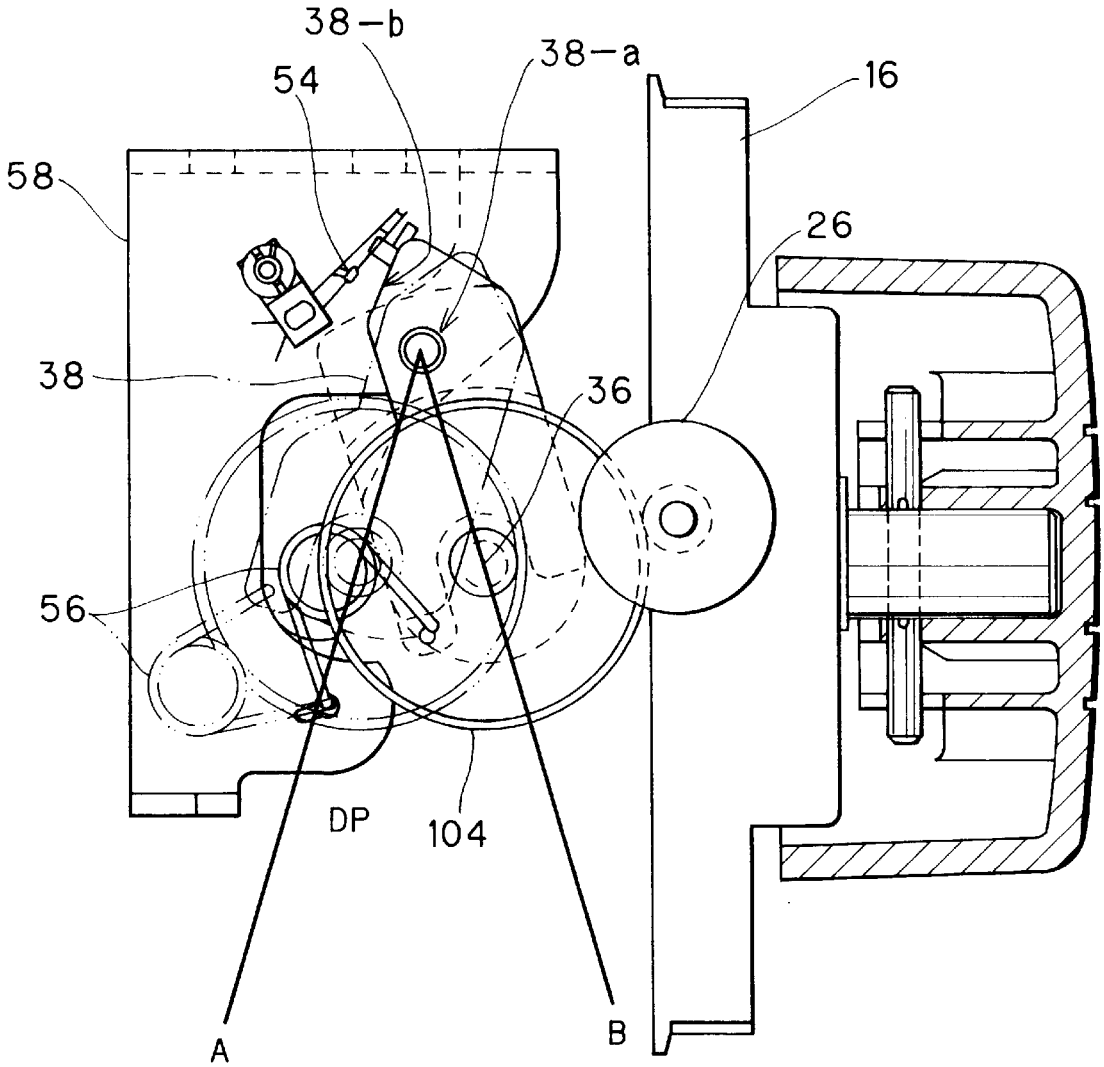
FIG. 6 is a top view in partial cross section showing a thread end support plate of the bobbin thread winding mechanism during a bobbin attachment/detachment condition and a thread wind-up condition.

The arm 38 is disposed at a substantial axial center of the thread wind-up shaft 36 and is provided for rotatably supporting the thread wind-up shaft 36. As shown in FIG. 6, the arm 38 is disposed on a shaft support portion 38-*a*. The shaft support portion 38-*a*, and consequently the arm 38 and the thread wind-up shaft 36, is pivotable between a bobbin attachment/detachment condition A, shown in broken line in FIG. 6, and a thread wind-up condition B, shown in solid line in FIG. 6. In the bobbin attachment/detachment condition A, the rubber ring 40 is separated from the pulley so that rotational drive force from the pulley 16 is not transmitted to the bobbin 62. In the thread wind up condition B, the rubber ring is pressed into contact with the pulley 16 so that rotation drive force from the pulley 16 is transmitted to the bobbin 62.

As shown in FIG. 6, a thread wind-up holder 58 is fixed to the sewing machine arm. A torsion coil spring 56 is attached at its left tip, that is, as viewed in FIG. 6, to the thread wind-up holder 58 and at the right tip to the arm 38. With this configuration, the right tip of the torsion coil spring 56 follows an arc-shaped pathway when the arm 38 pivots between the bobbin attachment/detachment condition A and the thread wind-up condition B. When the right tip of the torsion coil spring 56 is on the right side of a dead point DP along the arc-shaped pathway, the torsion coil spring 56 urges the arm 38 into contact with the pulley 16. On the other hand, when the right tip of the torsion coil spring 56 is on the left side of the dead point DP, the torsion coil spring 56 urges the arm 38 an opposite direction away from the pulley 16. A thread wind-up switch 54 is fixed to the thread wind-up holder 58. A switch pressing surface 38-*b* for turning the thread wind-up switch 54 on and off is formed at the side surface of the arm 38.

When the thread wind-up shaft 36 is in the thread wind-up condition B, the rubber ring 40 contacts the side surface of the pulley 16 and the switch pressing surface 38-*b* of the arm 38 contacts both terminals of the thread wind-up switch 54. An electrical circuit (not shown in the drawings) is configured so that when the terminals of the thread wind-up switch 54 are in contact, then the sewing machine motor 20 is brought into a drivable condition, and when either of the terminals of the thread wind-up switch 54 are not in contact, then drive of the sewing machine motor 20 stops.

Figure 7:
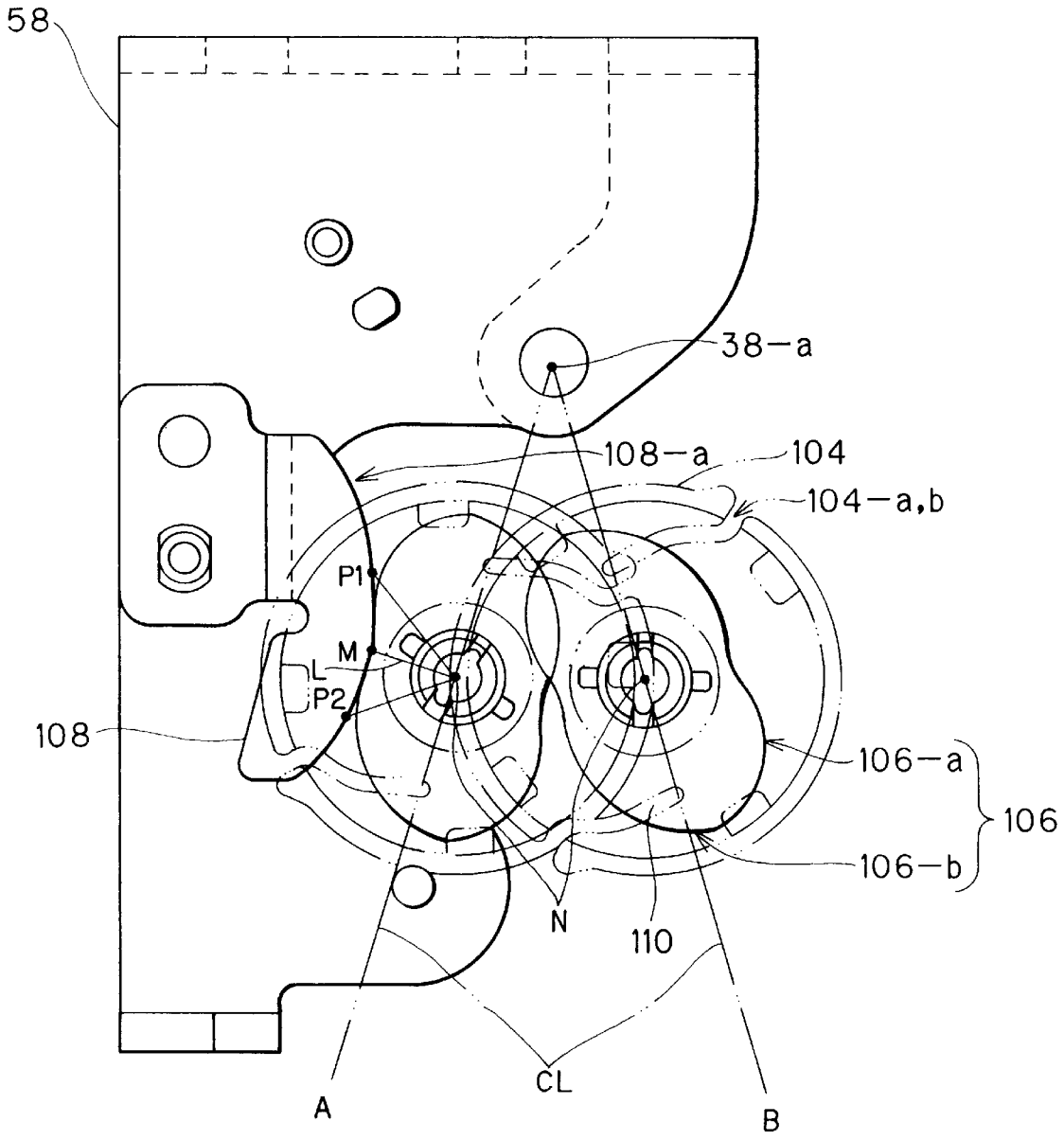
FIG. 7 is a top view in partial cross section showing a positioning cam portion of the bobbin thread winding mechanism during the bobbin attachment/detachment condition and the thread wind-up condition.

The positioning cam portion 106 is for positioning thread wind-up shaft 36, and consequently the thread end support plate 104. As shown in FIG. 7, the positioning cam portion 106 is formed centered on the thread wind-up shaft 36. The positioning cam portion 106 is formed with a violin shape having two indentation portions at its waist and two protruding portions at either side of the indentation portions. A cam abutment plate 108 is provided to the thread wind-up holder 58. The cam abutment plate 108 has a cam contacting surface 108-*a*. When the thread wind-up shaft 36 is in the bobbin attachment/detachment position A, then the cam contact surface 108-*a* engages with one of the indentation portions 106-*a*, 106-*b* of the positioning cam portion 106, thereby positioning the thread wind-up shaft 36, and consequently the thread end support plate 104.

Figure 8:
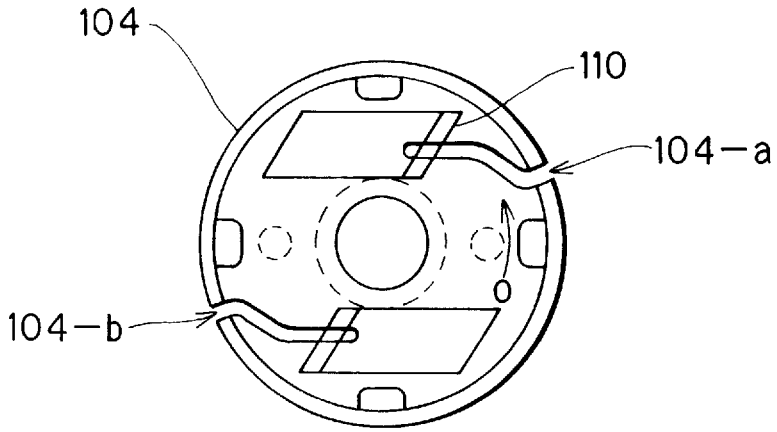
FIG. 8 is a plan view showing the thread end support plate of FIG. 5.

As shown in FIG. 8, the thread end support plate 104 is formed with two thread guide grooves 104*a*, 104*b*. The thread guide grooves 104*a*, 104*b* are formed to extend for a short distance from the outer peripheral surface of the thread end support plate 104 toward the axial center of the thread end support plate 104 and then in a direction indicated by arrow O in FIG. 8, that is, in a direction opposite rotational direction of the thread wind-up shaft 36.

A thread cutting blade 110 is disposed at the inward most end of each of the thread guide grooves 104*a*, 104*b* so that the blade edge faces where the thread guide grooves 104*a*, 104*b* are formed at the outer periphery of the thread end support plate 104. With this configuration, when, in a manner to be described later, one of the thread guide grooves 104*a*, 104*b* stops in confrontation with a user, that is, with respect to the axial center of the thread wind-up shaft 36, then the thread guided by that guide grooves 104-*a*, 104-*b* will be cut by the corresponding thread cutting blade 110. It should be noted that the positioning surfaces 106-*a*, 106-*b* are provided in the same number as the number of thread guide grooves 104*a*, 104*b* of the thread end support plate 104.

Next, a detailed explanation will be provided while referring to FIG. 7 for the relationship between the positioning cam surfaces 106-*a*, 106-*b* and the cam contact surface 108-*a*.

If, at the end of thread wind-up operations, the thread wind-up shaft 36 were to stop while in the thread wind-up condition B in FIG. 7, it would be impossible to predict what position the thread end support plate 104 would stop in. However, completion of bobbin winding operations is determined when the thread wound around the bobbin 62 contacts the bobbin winder stop latch 26. When the thread contacts the bobbin winder stop latch 26, the arm 38 will have exceeded the dead point DP of the torsion coil spring 56 and so will pivot around the pivot center 38-*a* from the thread wind-up condition B into the bobbin attachment/detachment condition A, whereupon the rubber ring 40 will separate from the pulley 16. The position of the thread wind-up shaft 36 at the time when the rubber ring 40 separates from the pulley 16 will be referred to as the stop position, hereinafter.

When the arm 38 is in the bobbin attachment/detachment condition A, and so exceeds the dead point DP of the torsion coil spring 56, the urging force of the torsion coil spring 56 will urge the positioning cam portion 106 so that its outer peripheral surface will abut against the cam abutment surface 108-*a* of the cam abutment plate 108. The urging force of the torsion coil spring 56 will force the protrusion portion of the positioning cam portion 106 to slide along the cam abutment surface 108-*a* until one of indentation portions of the positioning cam portion 106 is in stable engagement with the cam abutment surface 108-*a*. While the protrusion of the positioning cam portion 106 slides along the cam abutment surface 108-*a*, the thread wind-up shaft 36 will pivot either leftward or rightward as viewed in FIG. 4.

Here, the shape of the positioning cam portion 106 will be described while referring to FIG. 7. Although in the present embodiment, the positioning cam portion 106 is formed in a violin shape to provide the positioning cam surfaces 106-*a*, 106-*b*, the same effects can be achieved with other positioning cam surfaces having at least a plurality of protrusion portions and a stable surface, wherein the stable surface includes a point nearest the axial center N of the thread wind-up shaft 36 and so engages with the cam abutment surface 108-*a* to reliably prevent rotation of the thread wind-up shaft 36. The stable surface of the positioning cam portion 106 of the present embodiment is at the waist portion of the violin shape. The positioning cam portion 106 can be provided with any number of stable surfaces, as long as the same number of stable surfaces are provided as the number of protrusion portions.

In the present embodiment, the cam abutment surface 108-*a* is formed in a planer shape with a smooth curved surface defined by connecting point M and points P1, P2 as shown in FIG. 7. The point M is determined based on an imaginary line CL which passes between the fulcrum portion 38-*a* of the arm 38 and the axial center of the thread wind-up shaft 36, and another imaginary line L, which extends perpendicular to the central line CL. The point M is the point on the cam abutment surface 108-*a* intersected by the imaginary line L and closest to the axial center N of the thread wind-up shaft 36. The points P1, P2 are points on the cam abutment surface 108-*a* at either side of the imaginary line L and which become more distant from the axial center N of the thread wind-up shaft 36 as they separate from the imaginary line L. When the cam abutment surface 108-*a* is formed in this manner to a protruding curved shape, rather than a flat shape, the protrusion portion of the positioning cam 106 can be formed to an obtuse angle so that it can have an increased endurance.

Figure 9A:
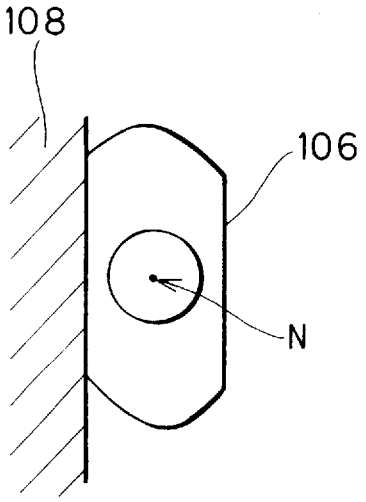
FIG. 9(*a*) is a top view showing a modification of the positioning cam portion.
Figure 9B:
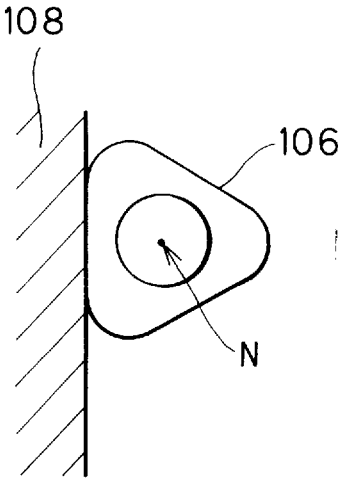

As shown in FIGS. 9(*a*) and 9(*b*), the positioning cam portion and the cam abutment surface can be formed with flat edges. In this case, rotation of the thread wind-up shaft 36 can be more cleanly stopped by abutment between the positioning cam abutment portion 108-*a* and the stable surface of the positioning cam portion. As shown in FIG. 9(*b*), the positioning cam portion 106 can be formed to a triangular shape. In any case, the cam abutment surface includes a point nearest the axial center N of the positioning cam portion and the cam abutment surface functions to stop rotation of the thread wind-up shaft 36.

Next, an explanation will be provided for the pin joint clutch 15 while referring to FIG. 4. The pin joint clutch 15 includes a clutch plate 46. The clutch plate 46 and the pulley 16 are freely rotatably disposed on the principle shaft 14. The clutch plate 46 is formed at its inner periphery with a key 46-*b* engaged with a key groove of the pulley 16. With this arrangement, the clutch plate 46 is capable of freely moving in its axial direction, but bound in its rotational direction with the pulley 16 and so rotates integrally with the pulley 16. The clutch plate 46 has a shaft portion around which a compression coil spring 64 is wrapped. The compression coil spring 64 constantly urges the clutch plate 46 leftward, that is, as viewed in FIG. 4.

A pin 42 is fixed to the lower tip of the arm 38 by being pressed fitted thereto. When the positioning cam portion 106 moves from the bobbin attachment/detachment position A to the thread wind-up condition B, the pin 42 moves rightward, as viewed in FIG. 4, so that its rightmost tip contacts the clutch plate 46 and urges the clutch plate 46 rightward against the urging of the compression coil spring 64.

The principle shaft 14 has attached thereto a principle shaft pin 48. The principle shaft pin 48 normally, that is, when the positioning cam portion 106 is in its bobbin attachment/detachment condition A shown in FIG. 7, engages in a pin groove 46-*a* formed at the leftward edge of the clutch plate 46 so that the clutch plate 46 rotates integrally with the principle shaft 14 when the positioning cam portion 106 is in its bobbin attachment/detachment condition A shown in FIG. 7. Accordingly, normally, the pulley 16 and the principle shaft 14 rotate integrally with each other when the pulley 16 rotates. However, the principle shaft does not rotate while the thread wind-up shaft 36 is in the thread wind-up condition B.

Next, an explanation will be provided for operations of the domestic sewing machine having a bobbin winding mechanism with the above-described configuration.

When a user wishes to perform sewing operations, he or she presses the start/stop switch 28 one time. As a result, an electric circuit (not shown in the drawings) begins drive of the sewing machine 20. Drive force of the sewing machine motor 20 is transmitted to the pulley 16 via the timing belt 18. The drive force from the pulley 16 is then further transmitted to the principle shaft 14 via the pin joint clutch 15. Rotational movement of the principle shaft 14 is converted into vertical movement of the needle bar 10 via the crank mechanism 12. The user then can perform sewing operations. Once sewing operations are completed, the user again presses the start/stop switch 28 so that the electrical circuit (not shown in the drawings) stops drive of the sewing machine motor 20. As a result, vertical movement of the needle bar 10 will stop.

Figure 10:
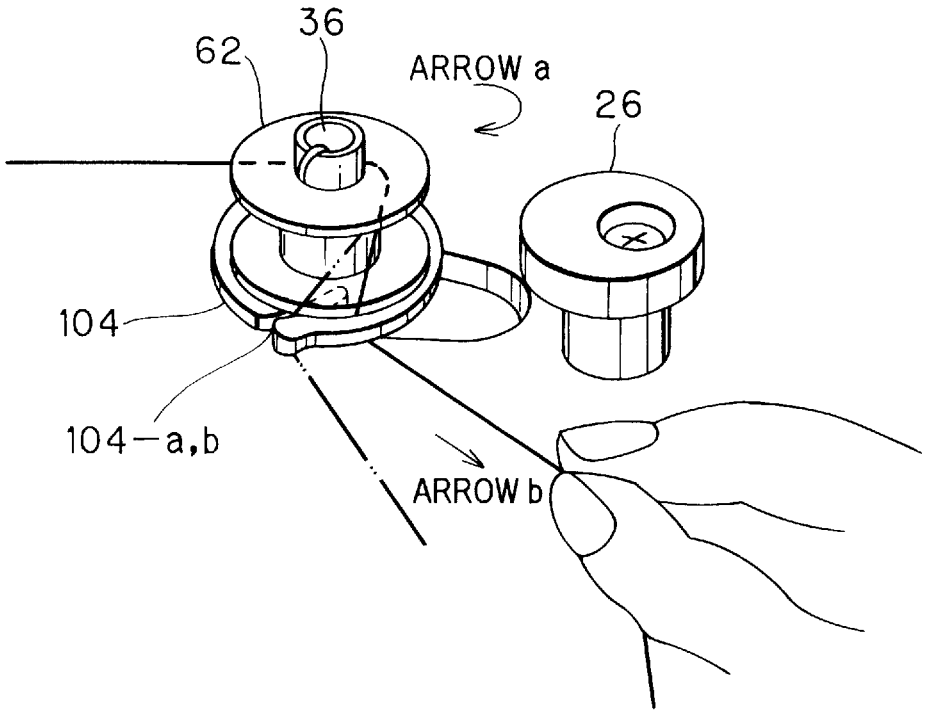
FIG. 10 is a perspective view for describing a procedure for threading a bobbin thread onto a bobbin using the thread end support plate of FIG. 5.

When the user wishes to perform bobbin thread winding operations, he or she inserts the bobbin 62 onto the bobbin wind-up shaft 36 and inserts the spool 30 onto the shaft 32 as shown in FIG. 1. Then as shown in FIG. 2, the user then draws thread from the spool 30 around the thread guide 24. Then, as shown in FIG. 10, the user draws the thread toward the bobbin 62, then wraps the thread halfway around the bobbin 62 as indicated by an arrow A in FIG. 10. Because the torsion coil spring 56 presses the positioning cam portion 106 of the thread wind-up shaft 36 against the cam abutment plate 108, one of the thread guide grooves 104*a*, 104*b* of the thread end support plate 104 will be positioned at a position easily accessible by the user. The cutter blade 110 will also be positioned in a fixed predetermined position. Therefore, the user can easily catch the thread in the closer one of the thread guide grooves 104*a* or 104*b* by drawing the thread toward the upper surface of the thread end support plate 104. The user then pulls the thread in the direction indicated by an arrow B in FIG. 10. As a result, the thread will be pulled between the lower surface of the flange of the bobbin 62 and the upper surface of the thread end support plate 104 and will be cut by the cutter blade 110.

By fixing the stopping position of the cutter blade 110 using the positioning cam portion 106, an angle at which the blade contacts the thread is also fixed so that the thread can be cut at an optimum angle. Further, the outer peripheral portion of the thread end support plate 104 near the cutter blade 110 functions to hold the thread end in place. Because the thread end support plate 104 stops at a fixed position, the condition wherein the drawn out thread is sandwiched when it is cut is also fixed. The thread end can be reliably sandwiched between the lower surface of the bobbin 26 and the thread end support plate 104 near the cutter blade 110.

The user then moves the bobbin 62 and the thread wind-up shaft 36 into the thread wind-up condition B show in FIG. 7. It should be noted that the operations for bobbin threading described above for bobbin rewind operations can be performed alternatively after the thread wind-up shaft 36 is moved into its thread wind-up condition B. In this case, the rubber ring 40 will be in contact with the pulley 16 so that resistance will be applied against rotation of the thread wind-up shaft 36. As a result, the thread end support plate 104 will not easily be shifted out of position, thereby facilitating the bobbin threading operations.

When the user moves the bobbin 62 and the thread wind-up shaft 36 into the thread wind-up condition B, the arm 38 is moved toward the pulley 16 around the pivot fulcrum portion 38-*a* as indicated by solid line in FIG. 6. As a result, the clutch plate 46 of the pin joint clutch 15 will move via the pin 42 rightward as viewed in FIG. 4 against resistance from the clutch spring 64. The clutch groove 46-*a* of the clutch plate 46 will be separated from the engagement tip portion of the principle shaft pin 48 fixed to the principle shaft 14 so that the principle shaft 14 and the pulley 16 are disconnected from each other. Therefore, the principle shaft will not rotate during winding of the bobbin thread.

When the arm 38 moves rightward as viewed in FIG. 4 until the rubber ring 40 below the arm 38 abuts against the side surface of the pulley 16, both terminals of the thread winding switch 54 contact so that the sewing machine motor 20 is brought into a drivable condition. When the user presses the start/stop switch 28 once, the sewing machine motor 20 is driven and its drive force is transmitted to the pulley 16 via the timing belt 18. The drive force of the pulley 16 is not transmitted to the principle shaft 14 at this time. When the pulley 16 rotates, the rubber ring 40 will rotate because the rubber ring 40 is in abutment with the side surface of the pulley 16. The thread wind-up shaft 36 and the bobbin 62 then rotate in a predetermined direction integrally with the rubber ring 40.

Because, at this time, the bobbin thread is set between the two flanges of the bobbin 62 and so is guided by the flanges, the bobbin thread is wound around the periphery of the thread wind-up portion of the bobbin 62. The thread is reliably wound because the thread end is sandwiched between the lower surface of the bobbin 62 and the upper surface of the thread end support plate 104 by urging force of the compression coil spring 66.

When a predetermined length of the thread is wound around the periphery of the bobbin 62, thread wound around the bobbin 62 will contact the bobbin winder stop latch 26. As a result, the rubber ring 30 will separate from the side surface of the pulley 16 so that rotational drive force of the pulley 16 will no longer be transmitted to the rubber ring 40. At this time, the arm 38 exceeds the dead point DP of the torsion coil spring 56 so that the arm 38 automatically snaps back into the bobbin attachment/detachment condition A. Further, both terminals of the thread wind-up switch 54 will be taken out of contact so that drive of the sewing machine motor 20 stops and consequently, rotation of the pulley 16 stops. When taking the bobbin 62 of the thread wind-up shaft 36 to set the bobbin thread into the shuttle, by drawing the thread connected to the spool 30 through the closer one of the thread guide grooves 104*a* or 104*b*, the thread will be cut by the cutter blade 110 of the thread end support plate 104 so the user need not run to get scissors.

In the present embodiment, the thread wind-up shaft 36 and the thread end support plate 104 are configured to rotate integrally with each other. Therefore, at the end of bobbin thread winding operations, when the thread wind-up shaft 36 automatically moves into its predetermined stop position, the thread guide groove 104 supporting the thread and its cutter blade 110 will also move into a predetermined convenient position.

Figure 13:
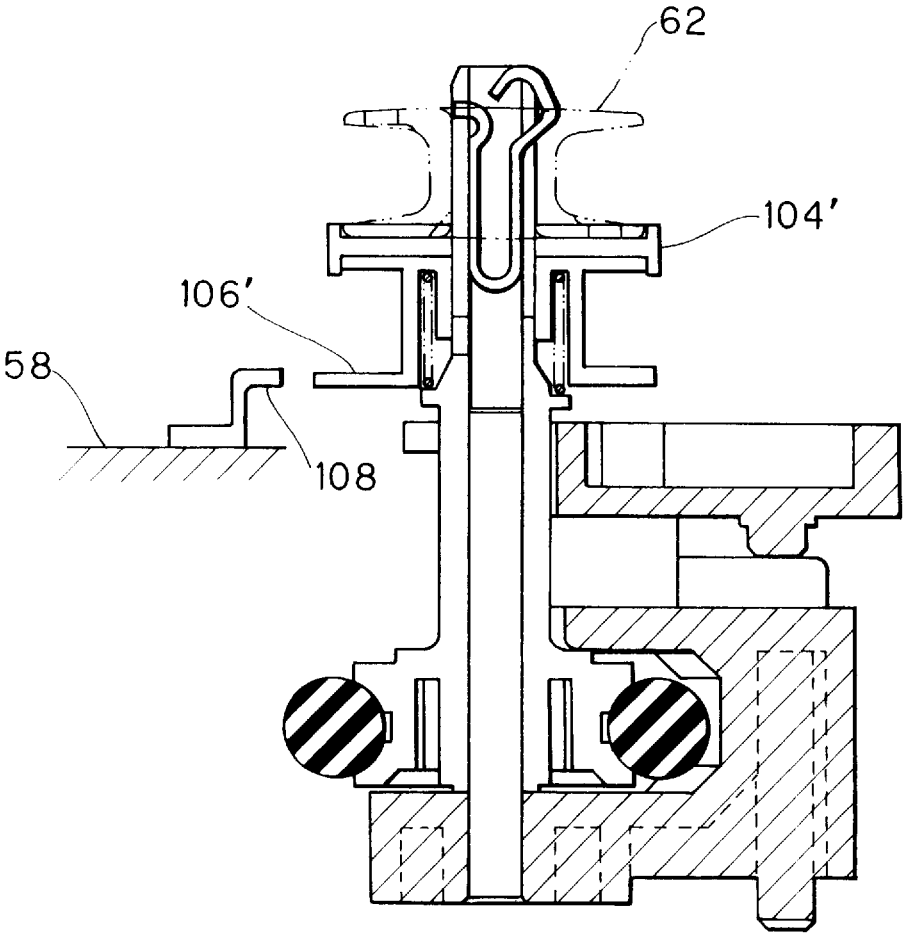
FIG. 13 is a cross-sectional view showing a bobbin thread winding mechanism according to a modification of the first embodiment.

However, there is no need to form the thread wind-up shaft 36 and the thread end support plate 104 so they rotate integrally with each other. Here, while referring to FIG. 13, one example will be explained for a configuration wherein the component for supporting the cutter blade and the bobbin thread need not be rotated integrally with the bobbin. In this example, as described above, the mounted bobbin 62 and the thread wind-up shaft 36 are configured to rotate integrally during bobbin winding operations. Also, a thread end support plate 104' and a positioning cam portion 106' are disposed on the thread wind-up shaft 36 so as to move into the bobbin attachment/detachment condition A in association with the thread wind-up shaft 36.

On the other hand, the thread end support plate 104' is stopped in place during bobbin winding operations during bobbin winding operations and the lower surface of the thread end support plate 104' is formed integrally with the positioning cam portion 106'. The thread end support plate 104' and the positioning cam portion 106' are formed to provide a gap between themselves and the thread wind-up shaft 36 so as to be slidable in the vertical direction with respect to the thread wind-up shaft 36 and the rubber ring 40.

In the present embodiment, two thread guide grooves 104*a*, 104*b* are provided for holding the thread end. However, this should not be considered a restriction on the number of such thread end support portions that must be provided. The principle objective of the present invention is to position the thread end support portion automatically at a position where the user can easily thread the bobbin thread. In the present embodiment, the number of thread holding and cutting portions were reduced to two positions. However, the number of thread holding and cutting portions can be reduced to one position in order to provide a simpler configuration.

Figure 11:
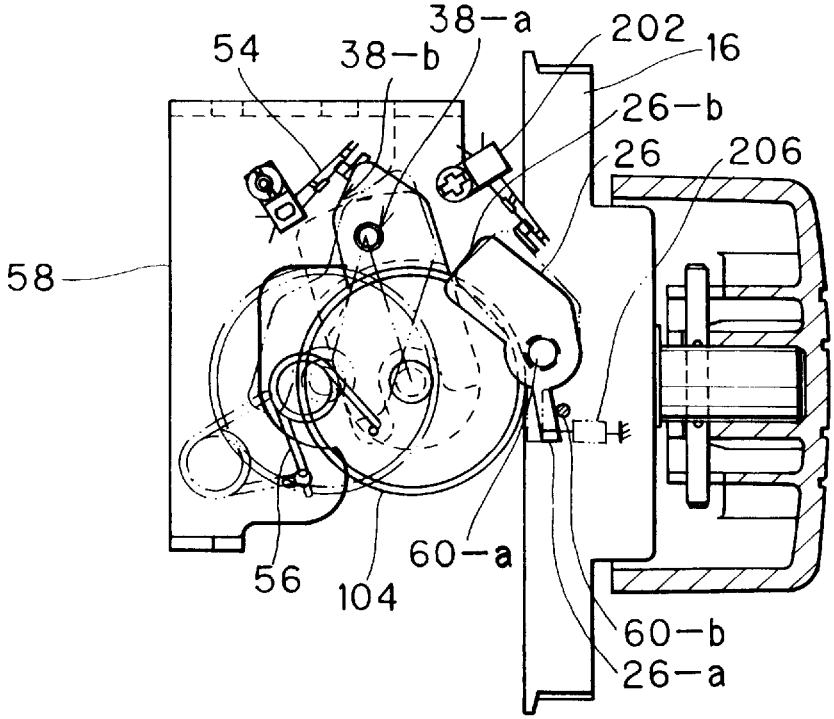
FIG. 11 is a top view in partial cross section showing a thread winding mechanism according to a second embodiment of the present invention.
Figure 12:
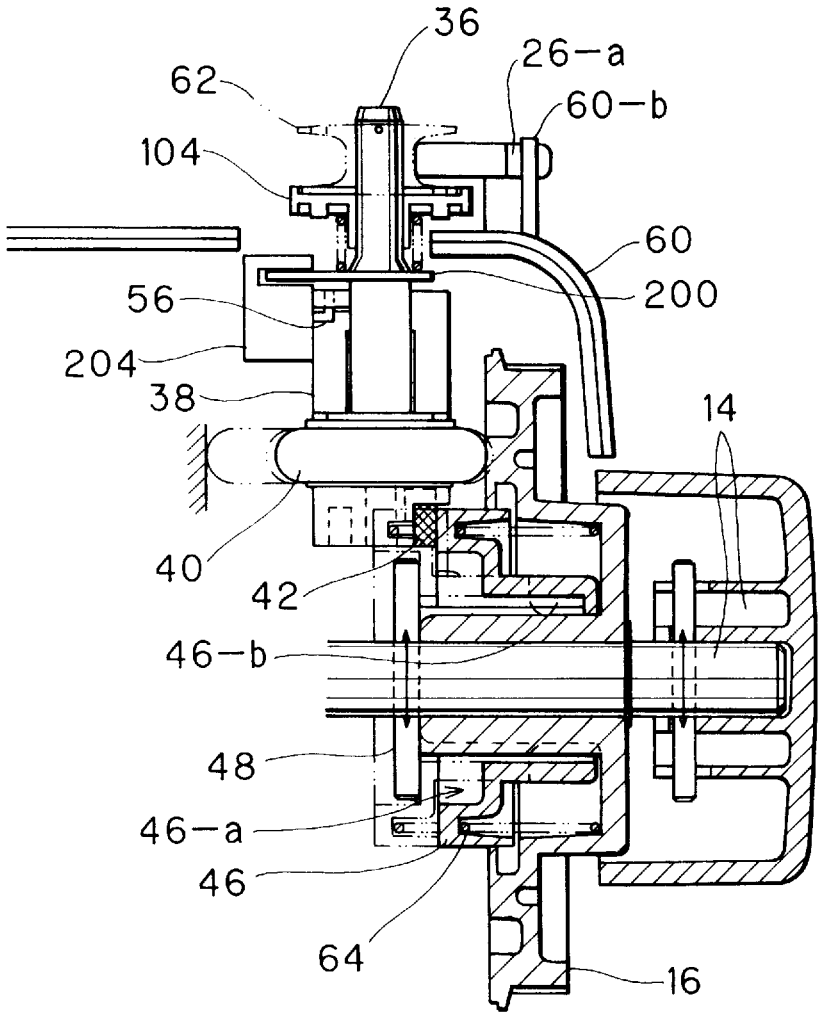
FIG. 12 is a side view in partial cross section showing the thread winding mechanism according to the second embodiment.
Figure 14:
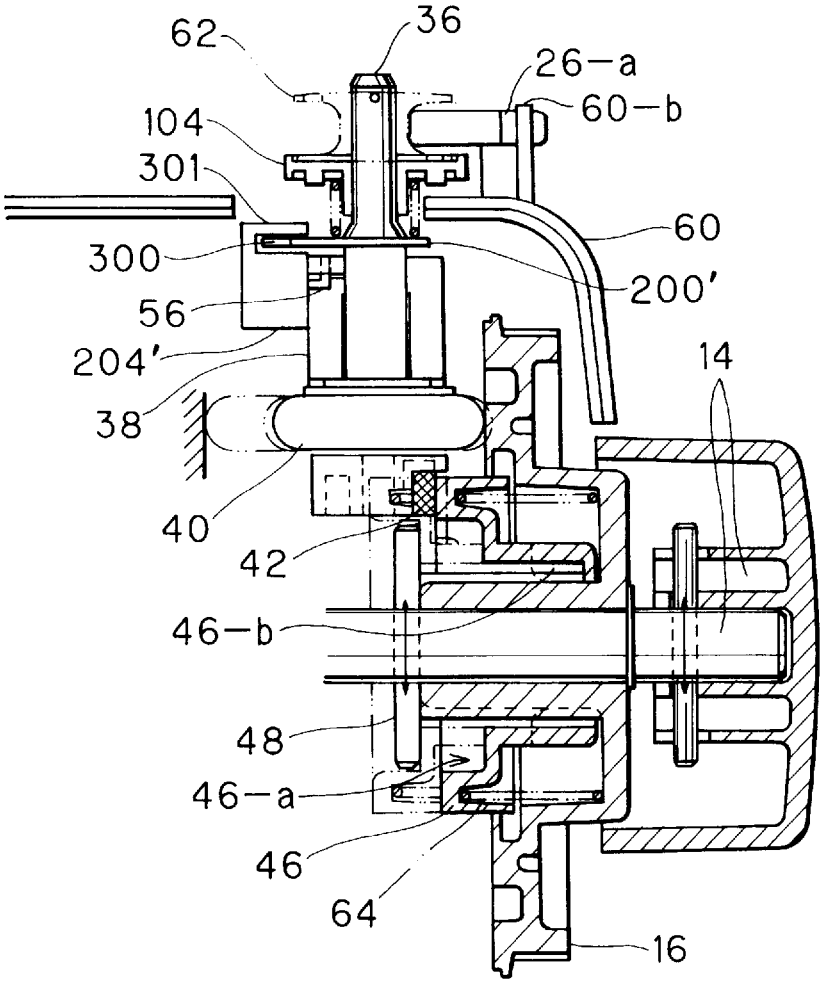
FIG. 14 is a side view in partial cross section showing the thread winding mechanism according to a third embodiment of the present invention.

A bobbin thread winding device according to a second embodiment will be explained while referring FIGS. 11 and 12. In the second embodiment, the number of thread holding and cutting portions is reduced to one position. As shown in FIG. 12, a shutter 200 formed with a slit at a single position is used in place of the positioning cam portion 106 and a photoelectric position sensor 204 is used in place of the cam abutment plate 108. Alternatively, an electrical position sensor 204' including a magnet 300 and a proximity switch 301 can be used as shown in FIG. 14 instead of the photoelectric position sensor 204. The shutter 200 and the photoelectric position sensor 204 are mounted on the arm 38. The bobbin winder stop latch 26 is mounted rotatable around a fulcrum 60-*a*. The bobbin winder stop latch 26 is provided with a protruding stopper tip 26-*a* at one side and a protruding detector tip 26-*b* at the other. A stopper portion 60-*b* is formed adjacent to the stopper tip 26-*a* on the cover 60 fixed on the sewing machine arm. A spring 206 is provided for urging the stopper tip 26-*a* into abutment against the stopper portion 60-*b* and for urging the detector tip 26-*b* toward the bobbin 62.

A switch 202 having a terminal portion is disposed on the thread wind-up holder 58 with its terminal portion in the pivoting path of the detector tip 26-*b* so that the switch 202 can detect rotational movement of the bobbin winder stop latch 26. When a predetermined length of thread is wound around the periphery of the bobbin 62, the thread will contact the bobbin winder stop latch 26 so that the bobbin winder stop latch pivots 26 toward the switch 202. As a result, the switch 202 will be turned on so that completion of thread winding operations can be determined. After this is recognized, a control system of the sewing machine can control rotation sewing machine motor 20 so that the thread wind-up shaft 36 stops at a predetermined position based on the signal from the photoelectric position sensor 204. With this configuration, the number of guide grooves can be reduced to one. Controlling drive of the motor using such a sensor requires only one thread support cutting portion.

Also, during in the bobbin attachment/detachment position A, the rubber ring 40 will be in abutment with a surface fixed to the arm. Because this prevents the thread guide position of the thread end support plate 104 from shifting out of position, the thread wind-up shaft 36 can be maintained in the thread wind-up condition B.

It should be noted that in the second embodiment, the rubber ring 40 and the pulley 16 will remain in contact with each other even after thread wind-up operations are completed. Therefore, the arm 38 will not automatically exceed the dead point DP of the torsion coil spring 56 in the manner of the first embodiment. Therefore, the arm 38 must be manually moved into the bobbin attachment/detachment position A before the bobbin can be removed.

The present invention allows reducing the number of thread end support positions to less than the number conventionally required. Also, the cutting blade is housed in contact with the thread end support plate, resulting in low cost, highly safe configuration. It should be noted that the bobbin winding mechanism of the present invention can be applied to industrial sewing machines or special bobbin thread winding machine and not just to domestic sewing machines.

Because the protrusion portion of the cam 106 abuts against the arc-shaped abutment plate 108, the bobbin thread winding mechanism can be produced at a low price.

What is claimed is:

1. A sewing machine, comprising:

a bobbin thread winding mechanism for winding a bobbin thread around a bobbin, the bobbin thread winding mechanism including:

a rotating member capable of rotating about an axis and adapted to receive and rotate the bobbin about the axis;

a supporter provided to the rotating member and adapted to support an end of the bobbin thread to be wound around the bobbin; and a positioner that positions the rotating member so that the supporter stops at a predetermined position.

2. A sewing machine as claimed in claim 1, further comprising a thread cutter provided to the rotating member and that cuts the end of the bobbin thread to be wound around the bobbin, the positioner positioning both the supporter and the thread cutter at the predetermined position.

3. A sewing machine as claimed in claim 2, wherein the supporter has a disk shape and is supported on the rotating member so that a center of the supporter is centered on a rotational axis of the rotating member, the supporter being formed with at least one thread guide groove extending first from an outer peripheral surface of the supporter toward the center of the supporter and then in a direction opposite rotational direction of the rotating member.

4. A sewing machine as claimed in claim 3, wherein the thread cutter includes a blade provided on the at least one thread guide groove near the center of the disk shape and facing the outer peripheral surface of the supporter.

5. A sewing machine as claimed in claim 2, further comprising:

a pulley that transmits drive force from a sewing machine motor of the sewing machine;

a principal shaft that drives vertical movement of a needle bar;

a clutch mechanism capable of connecting and interrupting transmission of drive force from the pulley to the principal shaft; and a clutch operator that operates the clutch mechanism to selectively connect and interrupt transmission of drive force from the pulley to the principal shaft and that operates the positioner to position the supporter and the thread cutter to stop at the predetermined position while operating the clutch mechanism to connect transmission of drive force from the pulley to the principal shaft.

6. A sewing machine as claimed in claim 5, wherein:

the rotating member includes a rotating shaft on which the positioner, the supporter, and the thread cutter are fixedly supported; and the clutch operator includes a pivot member for supporting the rotating shaft pivotable between a first position, wherein the positioner positions the supporter and the thread cutter to stop at the predetermined position and the clutch mechanism connects transmission of drive force from the pulley to the principal shaft, and a second position, wherein the positioner does not position the supporter and the thread cutter and the clutch mechanism interrupts transmission of drive force from the pulley to the principal shaft.

7. A sewing machine as claimed in claim 6, wherein the rotating shaft is capable of supporting the bobbin, and the clutch operator further includes:

a torsion coil spring having one tip pivotably connected to the pivot member and another end pivotably connected to a surface of the sewing machine, the torsion coil spring urging the pivot member to pivot the rotating shaft into the first position when the rotating shaft is on a first side of an equilibrium point of the torsion coil spring and into the second position when the rotating shaft is on a second side of the equilibrium point of the torsion coil spring; and a bobbin winder stop latch disposed adjacent to where the bobbin can be mounted to the rotating shaft so that when a predetermined amount of bobbin thread is wound around the bobbin, the bobbin winder stop latch abuts the bobbin thread and pushes the rotating shaft to the first side of the equilibrium point of the torsion coil spring.

8. A sewing machine as claimed in claim 7, wherein the supporter has a plate shape and is supported on the rotating member so that a center of the supporter is centered on a rotational axis of the rotating member, the supporter being formed with at least one thread guide groove extending first from an outer peripheral surface of the supporter toward the center of the supporter and then in a direction opposite rotational direction of the rotating member.

9. A sewing machine as claimed in claim 7, wherein:

the pulley is freely rotatably disposed on the principle shaft;

the clutch mechanism includes:

a clutch plate disposed centered on the principal shaft and slidable in an axial direction of the principal shaft, a pulley linking member that links the clutch plate with the pulley so that the clutch plate rotates integrally with the pulley, an urging means for urging the clutch plate to slide in the axial direction of the principal toward the clutch operator; and a principal shaft linking member that, when the clutch plate is slid by urging of the urging means, links the clutch plate with the principal shaft so that the clutch plate and the principal shaft rotate integrally together; and the clutch operator operates the clutch mechanism to interrupt transmission of drive force from the pulley to the principal shaft by sliding the clutch plate against urging of the urging means and to connect transmission of drive force from the pulley to the principal shaft by releasing the clutch plate so that the clutch plate slides with urging of the urging means, thereby linking the clutch plate with the principal shaft.

10. A sewing machine as claimed in claim 5, wherein:

the pulley is freely rotatably disposed on the principle shaft;

the clutch mechanism includes:

a clutch plate disposed centered on the principal shaft and slidable in an axial direction of the principal shaft, a pulley linking member that links the clutch plate with the pulley so that the clutch plate rotates integrally with the pulley, an urging means for urging the clutch plate to slide in the axial direction of the principal toward the clutch operator; and a principal shaft linking member that, when the clutch plate is slid by urging of the urging means, links the clutch plate with the principal shaft so that the clutch plate and the principal shaft rotate integrally together; and the clutch operator operates the clutch mechanism to interrupt transmission of drive force from the pulley to the principal shaft by sliding the clutch plate against urging of the urging means and to connect transmission of drive force from the pulley to the principal shaft by releasing the clutch plate so that the clutch plate slides with urging of the urging means, thereby linking the clutch plate with the principal shaft.

11. A sewing machine as claimed in claim 2, wherein the positioner includes a protrusion portion, the positioner positioning the rotating member by abutment of the protrusion portion.

12. A sewing machine as claimed in claim 1, wherein the supporter has a plate shape and is supported on the rotating member so that a center of the supporter is centered on a rotational axis of the rotating member, the supporter being formed with at least one thread guide groove extending first from an outer peripheral surface of the supporter toward the center of the supporter and then in a direction opposite rotational direction of the rotating member.

13. A sewing machine as claimed in claim 1, further comprises:

a pulley that transmits drive force from a sewing machine motor of the sewing machine;

a principal shaft that drives vertical movement of a needle bar;

a clutch mechanism capable of connecting and interrupting transmission of drive force from the pulley to the principal shaft; and a clutch operator that operates the clutch mechanism to selectively connect and interrupt transmission of drive force from the pulley to the principal shaft and that operates the positioner to position the supporter to stop at the predetermined position while operating the clutch mechanism to connect transmission of drive force from the pulley to the principal shaft.

14. A sewing machine as claimed in claim 13, further comprising a thread cutter and wherein the rotating member includes a rotating shaft on which the positioner, the supporter, and the thread cutter are fixedly supported;

the clutch operator includes a pivot member for supporting the rotating shaft pivotable between a first position, wherein the positioner positions the supporter to stop at the predetermined position and the clutch mechanism connects transmission of drive force from the pulley to the principal shaft, and a second position, wherein the positioner does not position the supporter and the clutch mechanism interrupts transmission of drive force from the pulley to the principal shaft.

15. A sewing machine as claimed in claim 14, wherein the rotating shaft is capable of supporting the bobbin, and the clutch operator further includes:

a torsion coil spring having one tip pivotably connected to the pivot member and another end pivotably connected to a surface of the sewing machine, the torsion coil spring urging the pivot member to pivot the rotating shaft into the first position when the rotating shaft is on a first side of an equilibrium point of the torsion coil spring and into the second position when the rotating shaft is on a second side of the equilibrium point of the torsion coil spring; and a bobbin winder stop latch disposed adjacent to where the bobbin can be mounted to the rotating shaft so that when a predetermined amount of bobbin thread is wound around the bobbin, the bobbin winder stop latch abuts the bobbin thread and pushes the rotating shaft to the first side of the equilibrium point of the torsion coil spring.

16. A bobbin thread winding mechanism as claimed in claim 15, wherein the supporter has a plate shape and is supported on the rotating member so that a center of the supporter is centered on a rotational axis of the rotating member, the supporter being formed with at least one thread guide groove extending first from an outer peripheral surface of the supporter toward the center of the supporter and then in a direction opposite rotational direction of the rotating member.

17. A sewing machine as claimed in claim 13, wherein:

the pulley is freely rotatably disposed on the principle shaft;

the clutch mechanism includes:

a clutch plate disposed centered on the principal shaft and slidable in an axial direction of the principal shaft, a pulley linking member that links the clutch plate with the pulley so that the clutch plate rotates integrally with the pulley, an urging means for urging the clutch plate to slide in the axial direction of the principal toward the clutch operator; and a principal shaft linking member that, when the clutch plate is slid by urging of the urging means, links the clutch plate with the principal shaft so that the clutch plate and the principal shaft rotate integrally together; and the clutch operator operates the clutch mechanism to interrupt transmission of drive force from the pulley to the principal shaft by sliding the clutch plate against urging of the urging means and to connect transmission of drive force from the pulley to the principal shaft by releasing the clutch plate so that the clutch plate slides with urging of the urging means, thereby linking the clutch plate with the principal shaft.

18. A sewing machine as claimed in claim 1, wherein the positioner includes a protrusion portion, the position positioning by abutment of the protrusion portion.

19. A sewing machine as claimed in claim 18, further comprising an abutment protrusion, wherein the positioner has a violin shape with two indentation portions and two protrusion portions in alternation about its periphery, at least one of the protrusion portions abutting against and at least one of the indention portions engaging with the abutment protrusion to position the rotating member.

20. A sewing machine as claimed in claim 18, further comprising a flat surface, wherein the positioner has two flat portions and two curved portions in alternation about its periphery, at least one of the flat portions engaging with the flat surface to position the rotating member.

21. A sewing machine as claimed in claim 18, further comprising a flat surface, wherein the positioner has a triangular shape with flat portions and curved portions in alternation about its periphery, at least one of the flat portions engaging with the flat surface to position the rotating member.

22. A sewing machine as claimed in claim 1, wherein the positioner includes:

a sensor for detecting rotational position of the rotating member; and a control system for controlling rotation of the rotating member so that the supporter stops at the predetermined position.

23. A sewing machine as claimed in claim 22, wherein the sensor includes:

a shutter formed with a single slit and disposed so as to be rotatable integrally with the rotating member; and an optical sensor for detecting the slit in the shutter, thereby detecting rotational position of the rotating member.

24. A sewing machine as claimed in claim 22, wherein the sensor includes:

a disk provided with a single magnet and disposed so as to be rotatable integrally with the rotating member; and a proximity switch that detects the magnet on the disk, thereby detecting rotational position of the rotating member.

25. A bobbin thread winding mechanism for winding a bobbin thread around a bobbin, comprising:

a rotating member capable of rotating about an axis and adapted to receive and rotate the bobbin about the axis;

a thread cutter provided to the rotating member and that cuts an end of the bobbin thread to be wound around the bobbin; and a positioner that positions the rotating member so that the thread cutter stops at a predetermined position.

26. A bobbin thread winding mechanism as claimed in claim 25, wherein the positioner includes a protrusion portion, the positioner positioning the rotating member by abutment of the protrusion portion.

27. A bobbin thread winding mechanism as claimed in claim 26, further comprising a sewing machine having a protrusion, wherein the positioner has a violin shape with two indentation portions and two protrusion portions in alternation about its periphery, at least one of the protrusion portions abutting against and at least one of the indentation portions engaging with the protrusion of the sewing machine to position the rotating member.

28. A bobbin thread winding mechanism as claimed in claim 26, further comprising a sewing machine having a flat surface, wherein the positioner has two flat portions and two curved portions in alternation about its periphery, at least one of the flat portions engaging with the flat surface of the sewing machine to position the rotating member.

29. A bobbin thread winding mechanism as claimed in claim 26, further comprising a sewing machine having a flat surface, wherein the positioner has a triangular shape with flat portions and curved portions in alternation about its periphery, at least one of the flat portions engaging with the flat surface of the sewing machine to position the rotating member.

* * * * *